US006041974A

United States Patent [19]

Poitras et al.

[11] Patent Number: 6,041,974

[45] Date of Patent: Mar. 28, 2000

[54] WALL MOUNTED FLUID DISPENSER

[75] Inventors: James W. Poitras, Holliston; Dennis A. Nickerson, Medway; Edwin W. Wlodyka, Ashland, all of Mass.

[73] Assignee: Highland Laboratories, Inc., Ashland, Mass.

[21] Appl. No.: 09/182,319

[22] Filed: Oct. 30, 1998

[51] Int. Cl.[7] ..... B67D 5/06

[52] U.S. Cl. ..... 222/180; 222/173; 222/321.1

[58] Field of Search ..... 222/180, 173, 222/321.1, 321.7, 321.8, 175

[56] References Cited

U.S. PATENT DOCUMENTS

| | | | |
|---|---|---|---|
| 2,652,952 | 9/1953 | Mowbray | 222/180 |
| 3,349,967 | 10/1967 | Schneller | 222/180 |
| 3,652,053 | 3/1972 | Poitras et al. . | |
| 4,280,638 | 7/1981 | Keihm | 222/180 |
| 4,615,476 | 10/1986 | Hobbs et al. . | |
| 4,651,902 | 3/1987 | Hobbs et al. . | |
| 5,632,418 | 5/1997 | Brown | 222/180 |

*Primary Examiner*—David J. Walczak
*Attorney, Agent, or Firm*—John E. Toupal; Harold G. Jarcho

[57] ABSTRACT

A support apparatus for a fluid dispenser having a container with a body portion, a neck portion defining an opening and a flange; and a fluid pump mechanism for withdrawing fluid from the container. Included in the apparatus is a housing for mounting on an upright planar surface; the housing defining a guide, and a support surface for receiving the flange to removably support the container; a latch; and a retainer shaped and arranged for reciprocating movement on the guide between open and closed positions and in a first direction relative to the housing and for reciprocating movement in a second direction different than the first direction and between the closed position and a latched position. The retainer, in its open position, allows removal of the container from the housing, in its closed position, prevents removal, and, in its latched position, is prevented from movement in the first direction by the latch. The retainer discourages unauthorized removal of the container from the support apparatus.

34 Claims, 5 Drawing Sheets

WALL MOUNTED FLUID DISPENSER

BACKGROUND OF THE INVENTION

This invention relates generally to a fluid dispenser and, more particularly, to a fluid dispenser in which a fluid container is retained by a latching mechanism.

There exist various types of devices for dispensing fluids such as soap and lotions. For example, fluid dispensers are commonly provided in public and institutional restrooms to provide a sanitary source of fluids for washing or conditioning body parts such as the hands and face. Typically, such dispensers are wall mounted devices including a pump mechanism for producing controlled discharge of a containers liquid content. Generally, the pump mechanism consists of either a hand or foot operated pump.

One problem encountered with dispensers mounted in public facilities is the unauthorized removal of fluid containers utilized with the devices. Also, in certain applications, a variety of fluid substances are used for different purposes and, in certain instances, a given dispenser can be provided with a replacement container filled with an improper fluid. These problems were addressed by fluid dispensers disclosed in U.S. Pat. Nos. 4,615,476 and 4,651,902. However, the devices disclosed in those patents continue to exhibit certain deficiencies such as high cost, cumbersome required fluid container replacement procedures or an inability to satisfactorily insure proper mating of replacement fluid containers with appropriate dispensers.

The object of this invention, therefore, is to provide an improved fluid dispensing device which alleviates the problems described above.

SUMMARY OF THE INVENTION

The invention is a support apparatus for a fluid dispenser having a container with a body portion, a neck portion defining an opening and a flange; and a fluid pump mechanism for withdrawing fluid from the container. Included in the apparatus is a housing for mounting on an upright planar surface; the housing defining a guide, and a support surface for receiving the flange to removably support the container; a latch; and a retainer shaped and arranged for reciprocating movement on the guide between open and closed positions and in a first direction relative to the housing and for reciprocating movement in a second direction different than the first direction and between the closed position and a latched position. The retainer, in its open position, allows removal of the container from the housing in its closed position, prevents removal, and, in its latched position, is prevented from movement in the first direction by the latch. The retainer discourages unauthorized removal of the container from the support apparatus.

According to one feature of the invention, the housing defines an arcuate slot forming the support surface and arranged to receive the flange. The engaged slot and flange provide a secure mounting of the container.

According to another feature of the invention, the arcuate slot and flange have substantially conforming tapered cross-sections. The tapered cross-sections facilitate assembly of the container on the support.

According to another feature of the invention, the retainer includes a cover portion shaped and arranged to prevent removal of the flange from the slot with the retainer in its closed position; and the second direction is substantially transverse to the first direction. These features further restrict unauthorized removal of the container from the support.

According to a further feature of the invention, the retainer also includes elongated and parallel first and second brackets projecting from the cover portion; and the guide includes first and second guide slots for receiving, respectively, the first and second brackets and guiding movement of the retainer in the first and second directions. These features facilitate desired movement of the retainer between its open and closed positions.

According to still another feature of the invention, the latch includes a notch in at least one of the first and second brackets, and a wall portion of the housing extending into at least one of the first and second slots; and the wall portion is arranged to be received by the notch in response to movement of the retainer into its latched position. These features insure secure retention of the retainer in its latched position.

According to an important feature of the invention, the apparatus includes a stop preventing detachment of the retainer from the housing. The stop prevents inadvertent disengagement of the housing and retainer.

According to an additional feature of the invention, the arcuate slot and flange have substantially conforming wedge shaped cross sections. This feature simplifies assembly of a container into a housing.

The invention also encompasses a support apparatus for a fluid dispenser having a container with a body portion, a neck portion defining an opening and a flange; and a fluid pump mechanism for withdrawing fluid from the container. included in the apparatus is a housing defining a support surface for receiving the flange to removably support the container; and a retainer for detachably securing the container to the housing means and wherein the support surface includes an elongated arcuately shaped section; the flange includes an elongated, arcuately shaped segment substantially conforming to the section; one of the section and the segment defines at least one key tab; and the other of the section and the segment defines at least one key recess conforming to and engaging the key tab. The complementary key tab and key recess facilitate mating of a particular container with a particular support.

According to one feature of the above invention, the section and the segment together form a plurality of pairs of engaging tabs and recesses. This feature provides for desirable mating of a variety of different containers and supports.

According to another feature of the above invention, the section defines at least one key recess and the segment defines at least one key tab. This feature permits keying of a given housing to a plurality of different containers.

The invention further encompasses a fluid dispenser system having a housing of the type above and a detachable adapter having a flange receivable by the housing slot. After mounting of the adapter, the housing can accommodate conventional containers without neck defined flanges.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENTS

Figure 6:
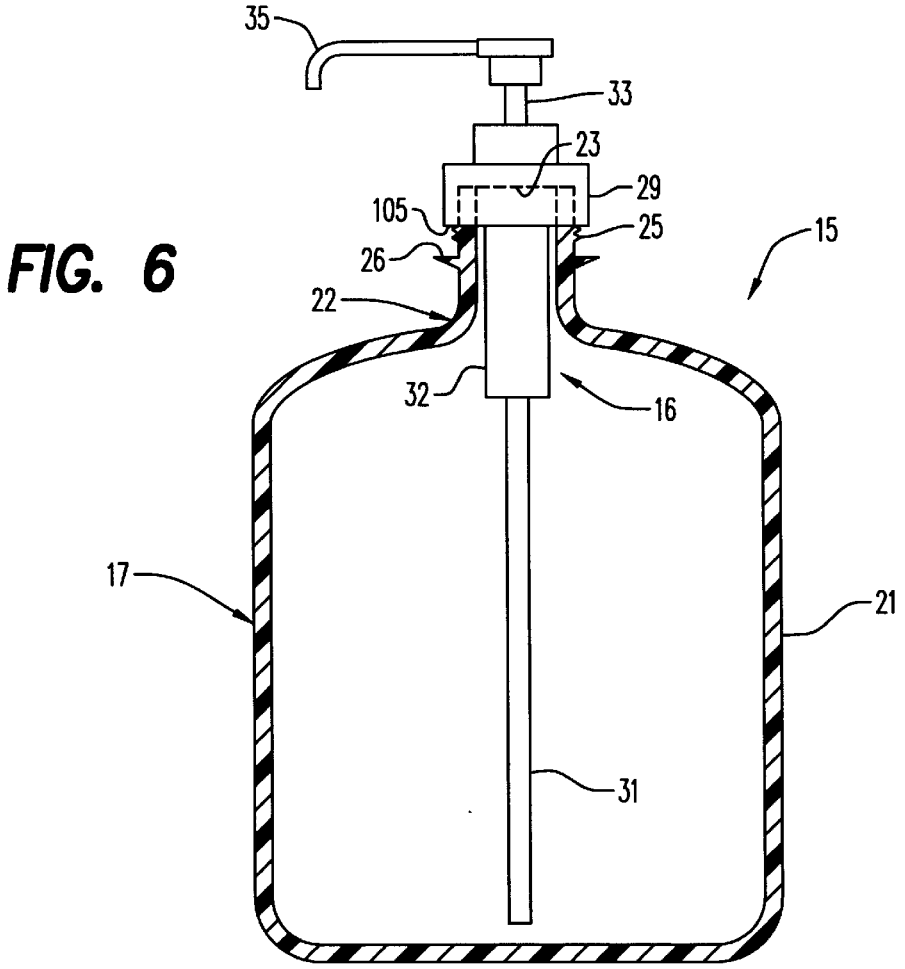
FIG. 6 is a front view of a fluid container and pump assembly utilized with the invention.

A dispenser support assembly 11 includes a housing 12 and a retainer member 13 detachably secured to and movable relative to the housing 12 as described hereinafter. Illustrated in FIG. 6 is a conventional hand operated fluid dispenser 15 received and retained by the support assembly 11. Included in the fluid dispenser 15 are a pump assembly 16 and a fluid container bottle 17 retained thereby. The container 17 includes a lower body portion 21 for receiving a suitable fluid such as soap or lotion and a neck portion 22, an upper end of which defines an opening 23. Also defined by an upper end of the neck portion 22 is a threaded portion 25 and a flange 26 located between the threaded portion 25 and the body portion 21 and having an upwardly tapered cross section. The pump assembly 16 is supported by a cap 29 threadedly engaged with the threaded portion 25 of the neck portion 22. Included in the pump assembly 16 is an open ended syphon tube 31 having an open end disposed adjacent to the bottom of the container 17, a fluid pump 32 supported by the cap 29, a reciprocating actuator stem 33 operatively coupled to the pump 32 and a nozzle 35 in fluid communication with the syphon tube 31 via the pump 32 and actuator stem 33. In response to manual reciprocation of the actuator stem 33, the pump 32 functions in a conventional manner to withdraw fluid doses from the container 17 for discharge through the nozzle 35.

The housing 12 includes a hood portion 41 projecting outwardly from a plate portion 42 adapted for mounting on a planar surface such as a vertical wall. A top wall portion 44 of the hood portion 41 defines a concave outwardly open, semi-cylindrical recess 45. Extending downwardly from the top wall portion 44 is a lower body portion 46 displaced substantially outwardly from the mounting plate portion 42. The body portion 46 defines a semi-cylindrical cavity 48 positioned below and concentric with the semi-cylindrical recess 45. Formed in an inner surface of the cavity 48 is an arcuate slot 51 having an upwardly tapered, wedge shaped cross section conforming substantially to the cross section of the container flange 26. A pair of transversely spaced apart guide slots 52, 53 extend through the lower body portion 46 along opposite sides of the recess 45. Extending upwardly into a lower portion of each of the guide recesses 52, 53 is a latching wall portion 56 of the body portion 46. Rearwardly facing surfaces 61 of the wall portions 56 and rearwardly facing surfaces 62 of the body portion 46 above the slots 52, 53 form respectively, stop surfaces 61, 62.

Figure 1:
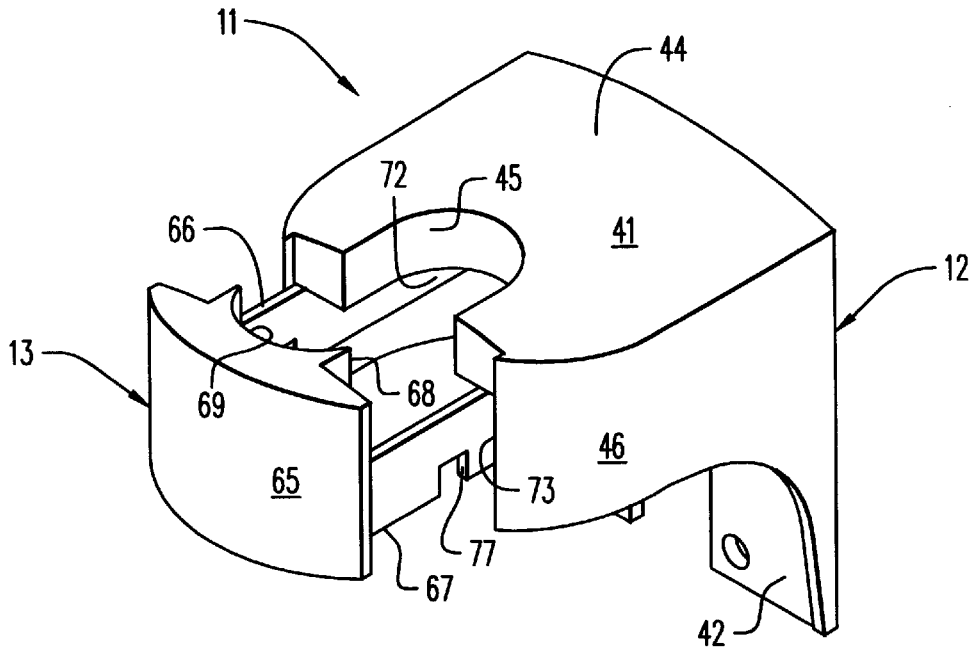
FIG. 1 is a right front perspective view of a dispenser support mechanism of the invention shown in an open position.
Figure 2:
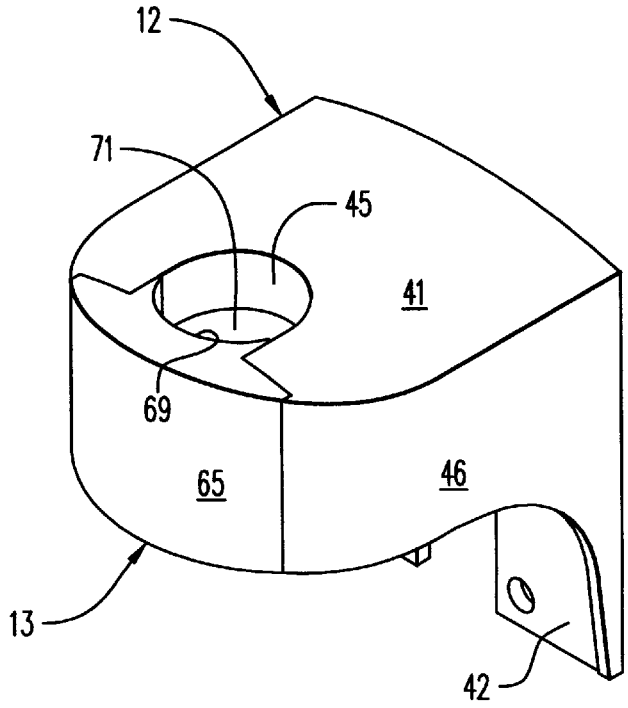
FIG. 2 is a right front perspective view of the mechanism shown in a closed position.
Figure 3:
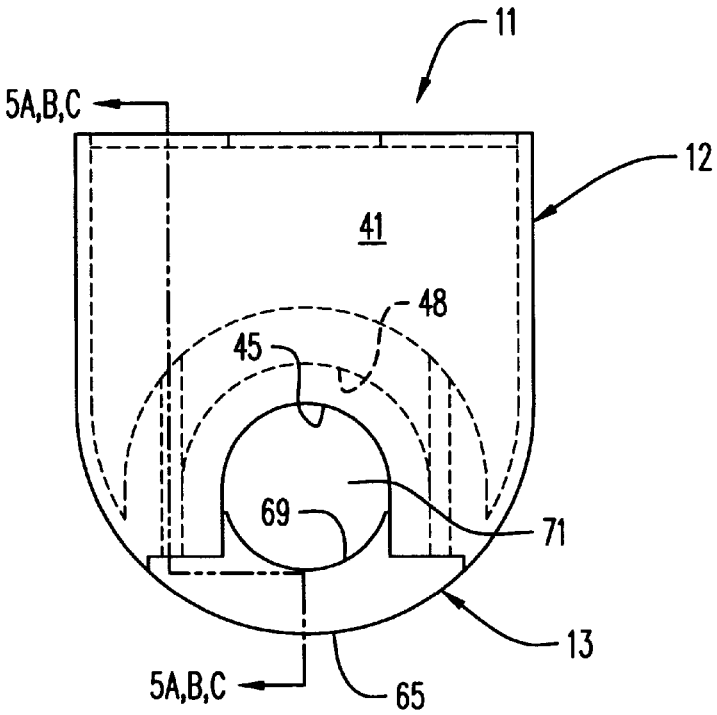
FIG. 3 is a top view of the mechanism shown in FIG. 2.
Figure 4:
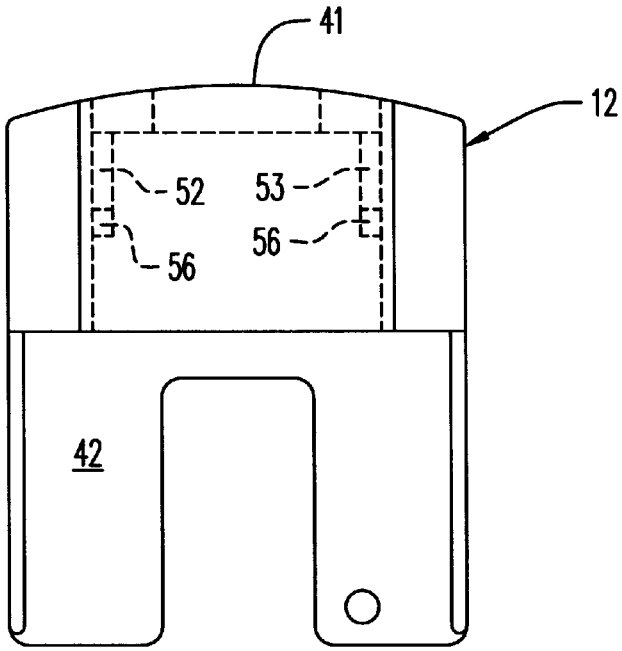
FIG. 4 is a rear view of the mechanism shown in FIG. 2.

The retainer member 13 includes an arcuate cover portion 65 and a pair of elongated parallel brackets 66, 67 projecting inwardly from opposite edges thereof. Also projecting inwardly from an upper inner end of the cover portion 65 is a lip 68 that projects into the concave recess 45 and has a concave outer surface 69 that forms therewith a closed opening 71 as shown in FIG. 2. Each of the brackets 66, 67 terminates with a pair of bifurcated arms 72, 73. Projecting transversely from outer ends of each of the arms 72, 73 is a projection stop 75. Also formed along lower edges of each of the brackets 66, 67 between the cover portion 65 and the bifurcated arms 72, 73 is a downwardly facing latching notch 77. The projection stops 75 are separated by a distance greater than the width of the slots 52, 53. Accordingly, assembly of the support housing 12 and retainer member 13 requires manual compression of the bifurcated arms 72, 73 to allow insertion thereof through, respectively, the slots 52, 53. Subsequent expansion of the bifurcated arms 72, 73 spreads the projection stop 75 into positions that engage the stop surfaces 61, 62 to prevent detachment of the retainer member 13 from the housing 12 as shown in FIG. 5A.

Prior to use of the support assembly 11, the mounting plate portion 42 of the housing 12 is mounted with suitable fasteners (not shown) to a wall surface of an enclosure in which a supply of fluid is desired. With the retainer member 13 fully withdrawn from the housing 12 as shown in FIG. 5A, an enlarged spacing therebetween allows entry of the fluid dispenser 15 shown in FIG. 6. The fluid dispenser 15 is suitably positioned with the flange 26 inserted into the tapered slot 51 which provides an elongated arcuately shaped support surface 81 therefor. Insertion of the flange 26 into the slot 51 is simplified by their wedge shaped cross sections thereby reducing required manufacturing tolerance. After insertion of the fluid container 17, the retainer member 13 is pushed inwardly producing rectilinear movement of the brackets 66, 67 in a first direction D (FIG. 5A). That movement extends between an open position shown in FIG. 5A to a closed position shown in FIG. 5B in which the cover portion 65 of the retainer member 13 engages the cap 29 of the container 17 to prevent movement of the retained flange 26 out of the supporting slot 51. With the retainer member 13 in its closed position, the fluid dispenser 15 cannot be removed from the support assembly 11. Next, the retainer member 13 is moved in a second direction d (FIG. 5B) transverse to the first direction D into a latched position shown in FIG. 5C. With the retainer member 13 in its latched position, the latching wall portions 56 enter the latching notches 77 in the brackets 66, 67 to prevent movement thereof in the first direction D. Accordingly, the fluid dispenser 15 is securely retained in the support assembly 11.

Figure 5A:
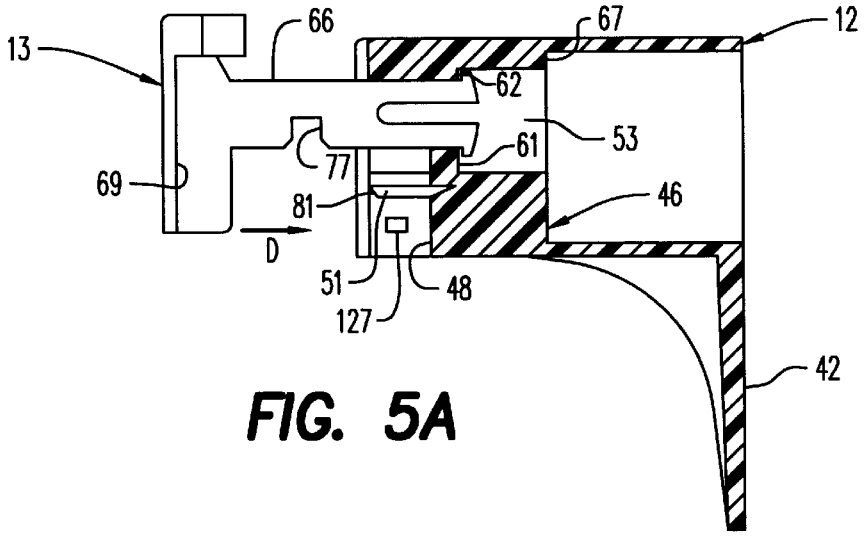
FIG. 5A is a cross-sectional view taken along lines 5A—5A of FIG. 3 with the mechanism in an open position.
Figure 5B:
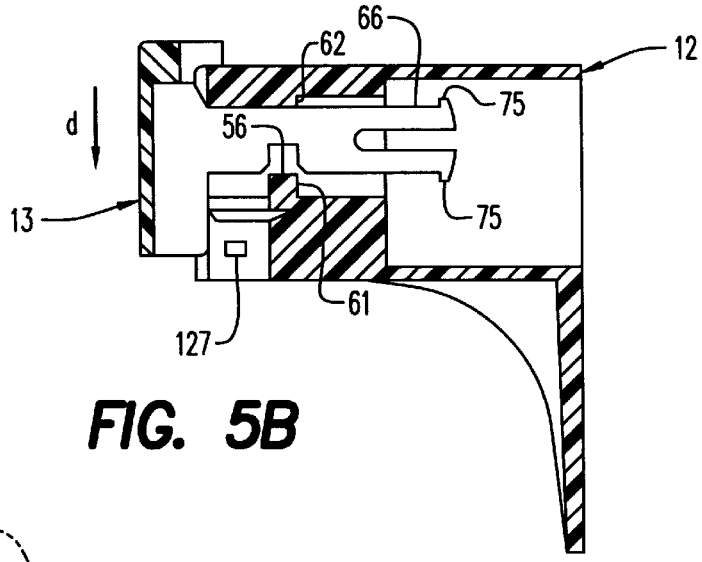
FIG. 5B is a cross-sectional view taken along line 5B—5B of FIG. 3 with the mechanism in a closed position.
Figure 5C:
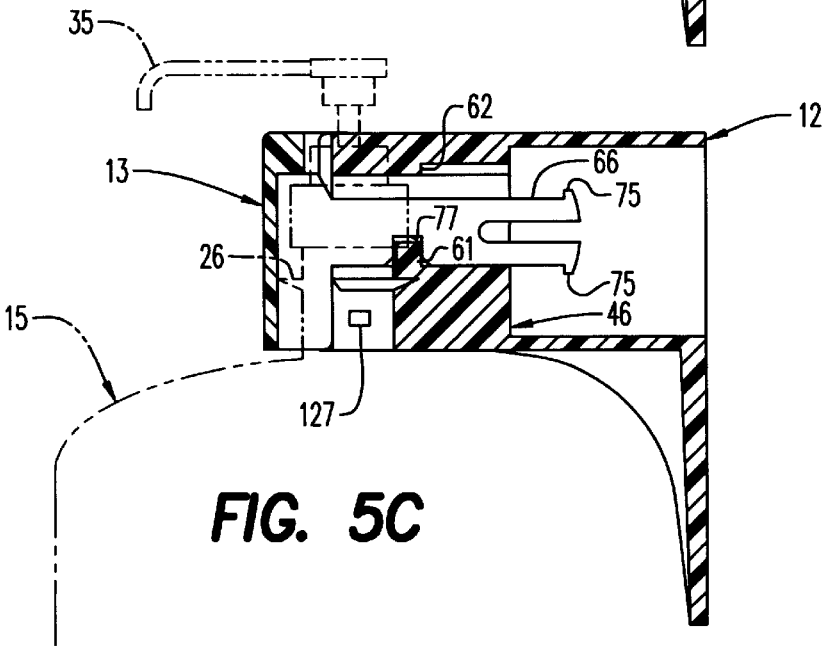
FIG. 5C is a cross-sectional view taken along lines 5C—5C in FIG. 3 with the mechanism in a latched position.

Removal of the fluid dispenser 15 requires return movement of the retainer member 13 into its open position shown in FIG. 5A. The manner for manually producing such motion is not readily apparent to one unacquainted with the structure of the support assembly 11 and, therefore, unauthorized removal of the fluid dispenser 15 is substantially averted. When replacement of the fluid dispenser 15 is desired, the retainer member first is moved upwardly in direction d to its closed position shown in FIG. 5B. That movement withdraws the wall portions 56 from the latching notches 77 in the brackets 66, 67 and allows further movement of the retainer member 13 in the outward direction D and into the open position shown in FIG. 5A. With the retaining member 13 in its open position, the increased spacing between the cover portion 65 and the concave recess 45 allows withdrawal of the container flange 26 from the slot 51. A refill fluid dispenser 15 then can be inserted into the support assembly 11 in the manner described above.

Figure 7:
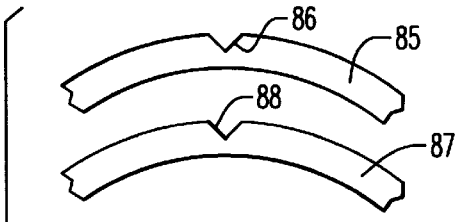
FIG. 7 is a fragmentary view illustrating a keying arrangement employed in the invention.

For applications in which a predetermined fluid substance is desired at the location in which a specific support assembly 11 is mounted, a particular dispenser 15 can be keyed to the specific support assembly in the manner shown in FIG. 7. An elongated arcuately shaped segment 85 of a tapered slot 51 is provided with a triangular shaped key tab 86. In addition, an elongated arcuately shaped section 87 of a predetermined container flange 26 is provided with a triangular shaped key recess 88 conforming to the key tab 86. During assembly of a keyed fluid dispenser 15 and support assembly 11, the key recess 88 in the flange section 87 receives the key tab 86 in the arcuate segment 85. However, a container 17 without a proper key recess 88 would be prevented from proper assembly with the keyed support assembly 11.

Figure 8:
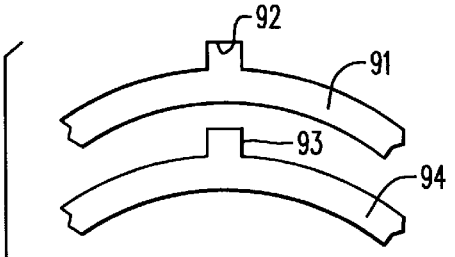
FIGS. 8–10 are fragmentary views illustrating other keying arrangement embodiments of the invention.

Illustrated in FIG. 8 is another keying arrangement embodiment in which an arcuately shaped segment 91 of a slot 51 is provided with a rectangular key recess 92 which conforms to a rectangularly shaped key tab 93 on a flange section 94 of a mated container 17. Again, the keying arrangement allows assembly of a properly mated fluid dispenser 15 and support assembly 11 but prevents reception thereby of an unkeyed dispenser or of an improperly keyed dispenser of, for example, the type shown in FIG. 7.

Figure 9:
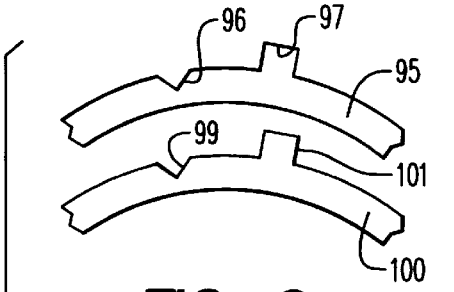

Illustrated in FIG. 9 is another keying arrangement embodiment in which an arcuate slot segment 95 is provided with a triangularly shaped key tab 96 and a circumferentially spaced apart, rectangularly shaped key recess 97. An arcuate flange section 100 of a mating container 17 is provided with a triangularly shaped key recess 99 conforming to the key tab 96 and a circumferentially spaced apart, rectangularly shaped key tab 101 conforming to the key recess 97. During assembly of the mating units, the triangular key tab 96 is received by the triangular key recess 99 and the rectangular key tab 101 is received by the rectangular key recess 97. The use of plural pairs of keying tabs and recesses increases the possible number of keyed support assembly and fluid dispenser combinations.

Figure 10:
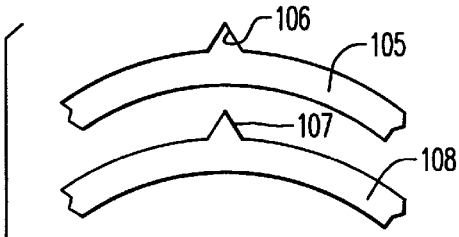

FIG. 10 depicts another keying arrangement embodiment in which an arcuately shaped segment 105 of a slot 51 is provided with a triangular key recess 106 which conforms to a triangularly shaped key tab 107 on a flange 108 of a mated container 17. Again, the keying arrangement allows assembly of a properly mated fluid dispenser 15 and support assembly 11 but prevents reception thereby of an unkeyed dispenser or of an improperly keyed dispenser of, for example, the type shown in FIG. 8. However, the flange 87 (FIG. 7) can be received by the slot 51 of FIG. 10 and the rectangular key recess 92 of the segment 91 (FIG. 8) can receive a container with the triangularly shaped key tab 107 of FIG. 10. Thus, a given arcuately shaped segment can accept a plurality of differently keyed containers while rejecting other containers.

Figure 11:
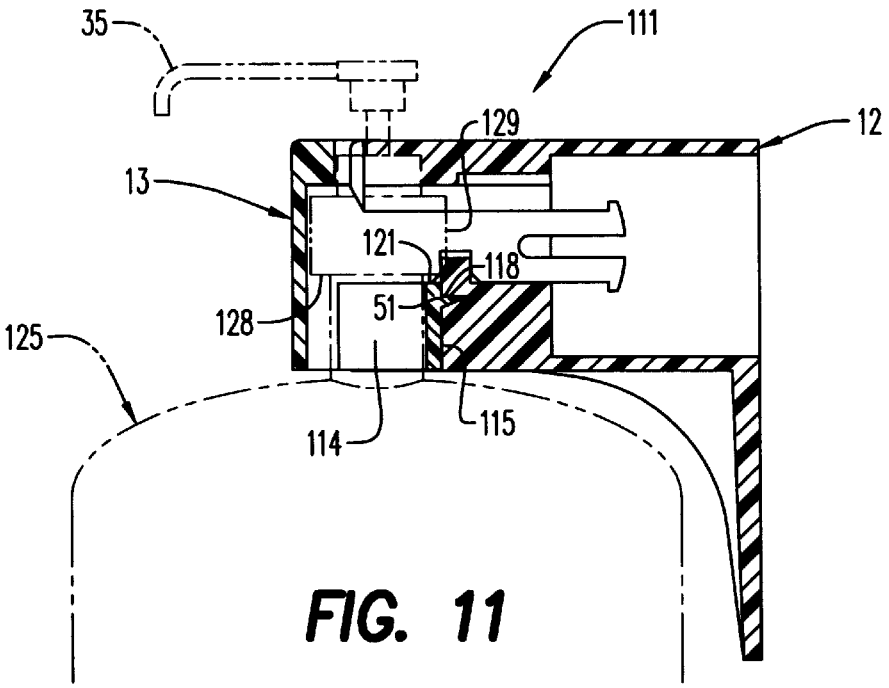
FIG. 11 is a cross-sectional view of another dispenser support embodiment of the invention.
Figure 12:
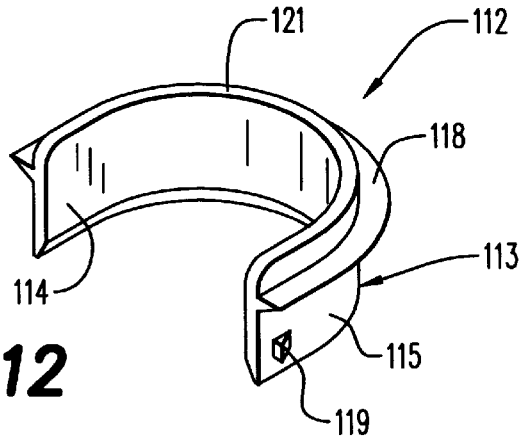
FIG. 12 is a perspective view of an adaptor member of the embodiment shown in FIG. 11.
Figure 13:
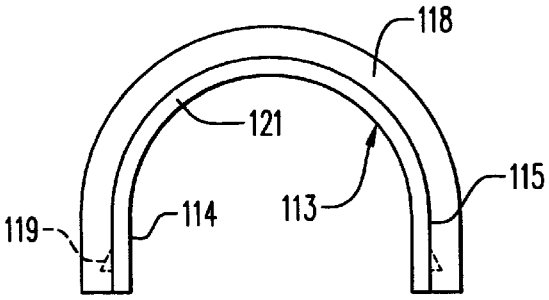
FIG. 13 is a top view of the adaptor member of the embodiment shown in FIG. 11.
Figure 14:
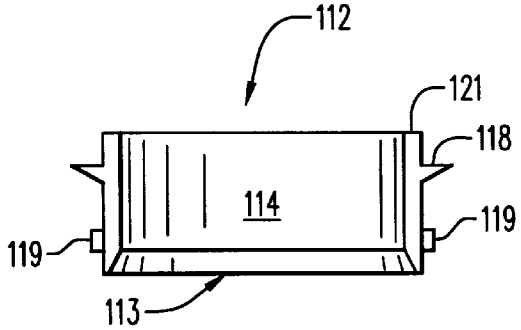
FIG. 14 is a cross-sectional view of the adaptor member shown in FIGS. 12 and 13.

Another dispenser support assembly embodiment 111 is shown in FIG. 11. The support assembly embodiment 111 is identical to the support assembly 11 shown in FIGS. 1–4 except for the inclusion of an adaptor 112 shown separately in FIGS. 12–14. The adaptor 112 is a semi-cylindrical member 113 having a concave inner surface 114 and a convex outer surface 115 defining an outwardly projecting arcuate flange portion 118. Also defined adjacent to opposite edges of each outer surface 115 is an outwardly projecting tab 119. An upper edge of the member 113 defines an upwardly projecting shoulder portion 121.

In certain applications, the adaptor 112 is mounted on the support assembly 11 of FIGS. 1–5. Such mounting facilitates use of the modified support assembly 111 with a conventional pump dispenser bottle 125 shown with dashed lines in FIG. 11. To assemble the embodiment 111, the outer surface 115 of the adaptor 112 is placed into engagement with the inner surface of the cavity 48 and the wedge-shaped flange 118 is received by the conforming slot 51 as shown in FIG. 11. During the assembly procedure, opposite ends of the member 113 are depressed providing clearance for the tabs 119. After the adaptor 112 reaches its fully inserted position, the tabs 119 spring inwardly into accommodating recesses 127 formed in the cylindrical cavity 48. After assembly, a conventional container dispenser 125 without a mounting flange 51 can be inserted into the support assembly 111 in the same manner as described above for assembly of the container 15. In this case a bottom edge surface 128 of a cap 129 is supported by the shoulder portion 121 of the adaptor 112.

Obviously, many modifications and variations of the present invention are possible in light of the above teachings. For example, the manually operated pump assembly 16 shown above could be replaced by a conventional foot operated pump assembly of the type shown, for example, in U.S. Pat. No. 3,652,053. Also, a lower surface 105 and a container cap 29 could form a flange supported by an upwardly facing support surface (not shown) of a modified housing. It is to be understood, therefore, that the invention can be practiced otherwise than as specifically described.

What is claimed is:

1. Support apparatus for a fluid dispenser comprising a container having a body portion, a neck portion defining an opening and a flange; and a fluid pump mechanism for withdrawing fluid from said container; said apparatus comprising:

housing means adapted for mounting on an upright planar surface; said housing means defining guide means, and a support surface for receiving said flange to removably support said container;

latch means; and retainer means shaped and arranged for reciprocating movement on said guide means between open and closed positions and in a first direction relative to said housing, and for reciprocating movement in a second direction different than said first direction and between said closed position and a latched position; and wherein said retainer means in said open position allows removal of said container from said housing means, in said closed position prevents said removal, and in said latched position is prevented from movement in said first direction by said latch means.

2. An apparatus according to claim 1 wherein said housing means defines an arcuate slot forming said support surface and arranged to receive said flange.

3. An apparatus according to claim 2 wherein said arcuate slot and said flange have substantially conforming tapered cross-sections.

4. An apparatus according to claim 3 wherein said retainer means comprises a cover portion shaped and arranged to prevent removal of said flange from said slot with said retainer means in said closed position.

5. An apparatus according to claim 4 wherein said second direction is substantially transverse to said first direction.

6. An apparatus according to claim 5 wherein said retainer means further comprises elongated and parallel first and second brackets projecting from said cover portion, and said guide means comprises first and second guide slots for receiving, respectively, said first and second brackets and guiding movement of said retainer means in said first and second directions.

7. An apparatus according to claim 6 wherein said latch means comprises a notch in at least one of said first and second brackets, and a wall portion of said housing means extending into at least one of said first and second slots; and said wall portion is arranged to be received by said notch in response to movement of said retainer means into said latched position.

8. An apparatus according to claim 1 including stop means preventing detachment of said retainer means from said housing means.

9. An apparatus according to claim 8 wherein said housing means defines an arcuate slot forming said support surface and arranged to receive said flange.

10. An apparatus according to claim 9 wherein said arcuate slot and said flange have substantially conforming tapered cross-sections.

11. An apparatus according to claim 10 wherein said retainer means comprises a cover portion shaped and arranged to prevent removal of said flange from said slot with said retainer means in said closed position.

12. An apparatus according to claim 11 wherein said second direction is substantially transverse to said first direction.

13. An apparatus according to claim 12 wherein said retainer means further comprises elongated and parallel first and second brackets projecting from said cover portion, and said guide means comprises first and second guide slots for receiving, respectively, said first and second brackets and guiding movement of said retainer means in said first and second directions.

14. An apparatus according to claim 13 wherein said latch means comprises a notch in at least one of said first and second brackets, and a wall portion of said housing means extending into at least one of said first and second slots, and said wall portion is arranged to be received by said notch in response to movement of said retainer means into said latched position.

15. An apparatus according to claim 14 wherein at least one of said brackets has bifurcated arms with spaced apart ends, and said stop means comprises a transversely extending projection on at least one of said ends; and said housing means further defines a stop surface for engaging said projection to prevent removal of said bracket from said slot.

16. An apparatus according to claim 1 wherein said support surface comprises an elongated, arcuately shaped section; said flange comprises an elongated, arcuately shaped segment substantially conforming to said section; one of said section and said segment defines at least one key tab; and the other of said section and said segment defines at least one key recess conforming to and engaging said key tab.

17. An apparatus according to claim 16 wherein said section and said segment together form a plurality of pairs of said engaging tabs and recesses.

18. Support apparatus for a fluid dispenser comprising a container having a body portion, a neck portion defining an opening and a flange; and a fluid pump mechanism for withdrawing fluid from said container; said apparatus comprising:

housing means adapted for mounting on an upright planar surface; said housing means defining a support surface for receiving said flange to removably support said container means; and retainer means for detachably securing said container to said housing means and wherein said support surface comprises an elongated section; said flange comprises an elongated segment substantially conforming to said section; one of said section and said segment defines at least one key tab; and the other of said section and said segment defines at least one key recess conforming to and engaging said key tab.

19. An apparatus according to claim 18 wherein said section and said segment together form a plurality of pairs of said engaging tabs and recesses.

20. An apparatus according to claim 19 wherein said housing means defines a slot forming said support surface and arranged to receive said flange.

21. An apparatus according to claim 18 wherein each of said section and said segment is arcuately shaped.

22. An apparatus according to claim 21 wherein said section and said segment together form a plurality of pairs of said engaging tabs and recesses.

23. An apparatus according to claim 22 wherein said housing means defines a slot forming said support surface and arranged to receive said flange.

24. An apparatus according to claim 18 wherein said section defines at least one, key recess, and said segment defines at least one key tab.

25. Convertible support apparatus for a plurality of fluid dispensers each comprising a container having a body portion, a neck portion defining an opening and a flange; and a fluid pump mechanism for withdrawing fluid from said container; said apparatus comprising:

housing means adapted for mounting on an upright planar surface; said housing means defining a support surface for receiving said flange to removably support said container means; and retainer means for detachably securing said container to said housing means and wherein said support surface comprises an elongated section; each said flange comprises an elongated segment substantially conforming to said section; said section defines at least one key recess; and each said segment defines at least one key tab receivable by said key recess; and wherein said key tabs are shaped differently from each other.

26. An apparatus according to claim 25 wherein said section and said segment together form a plurality of pairs of said engaging tabs and recesses.

27. Support apparatus for a fluid dispenser comprising a container having a body portion, a neck portion with an axis and defining an opening and a flange projecting transversely from said neck portion; and a fluid pump mechanism for withdrawing fluid from said container; said apparatus comprising:

housing means adapted for mounting on an upright planar surface; said housing means defining an arcuate slot having an opening shaped and arranged for receiving said flange in response to movement of said container in a direction transverse to said axis, and top and bottom surfaces for engaging said flange to removably support said container and to restrict axial movement thereof; each of said flange and said slot having substantially conforming wedge shaped cross sections; and retainer means for detachably securing said container to said housing means.

28. An apparatus according to claim 27 wherein said bottom surface is upwardly tapered.

29. Support apparatus for a plurality of different containers each having a body portion, a neck portion defining an opening, a cap covering said opening and having a bottom edge surface projecting transversely from said neck portion, and a fluid pump mechanism for withdrawing fluid through said cap; said neck portion of only one of said containers defining a neck flange; said apparatus comprising:

housing means adapted for mounting on an upright planar surface; said housing defining a slot for receiving said neck flange to removably support said one container;

retainer means for detachably securing either of said containers to said housing means; and adaptor means defining an adaptor flange receivable by said slot and defining an upwardly facing surface for supporting said bottom edge surface of said container without said neck flange.

30. An apparatus according to claim 29 wherein said adaptor is a semi-cylindrical member having an outer surface defining said adaptor flange.

31. An apparatus according to claim 30 wherein said member has an upper edge forming said upwardly facing surface.

32. An apparatus according to claim 31 wherein said member is flexible, said outer surface defines a plurality of outwardly projecting tabs, and said housing means defines recesses for receiving said tabs.

33. An apparatus according to claim 32 wherein said slot, said adaptor flange and said neck flange have substantially conforming wedge shaped cross sections.

34. An apparatus according to claim 33 wherein each of said flange and said slot has an upwardly tapered bottom surface.

* * * * *